US010302294B2

(12) United States Patent
Ro

(10) Patent No.: US 10,302,294 B2
(45) **Date of Patent: *May 28, 2019**

(54) LIGHT-EMITTING DIODE ILLUMINATION TYPE ELLIPSOIDAL SPOTLIGHT

(71) Applicant: Bic Light Co., Ltd., Seongnam-si, Gyeonggi-do (KR)

(72) Inventor: Seung Hwan Ro, Seongnam-si (KR)

(73) Assignee: Bic Light Co., Ltd., Gyeonggi-do (KR)

( * ) Notice: Subject to any disclaimer, the term of this patent is extended or adjusted under 35 U.S.C. 154(b) by 543 days.

This patent is subject to a terminal disclaimer.

(21) Appl. No.: 15/022,053

(22) PCT Filed: Jul. 15, 2014

(86) PCT No.: PCT/KR2014/006305
§ 371 (c)(1),
(2) Date: Nov. 28, 2016

(87) PCT Pub. No.: WO2015/012517
PCT Pub. Date: Jan. 29, 2015

(65) Prior Publication Data

US 2017/0198898 A1 Jul. 13, 2017

(30) Foreign Application Priority Data

Jul. 22, 2013 (KR) ..... 10-2013-0086313

(51) Int. Cl.
*F21V 29/51* (2015.01)
*F21V 29/67* (2015.01)
(Continued)

(52) U.S. Cl.
CPC ..... *F21V 29/51* (2015.01); *F21V 3/00* (2013.01); *F21V 5/008* (2013.01); *F21V 5/04* (2013.01); *F21V 17/02* (2013.01); *F21V 17/107* (2013.01); *F21V 17/12* (2013.01); *F21V 21/088* (2013.01); *F21V 21/30* (2013.01); *F21V 21/40* (2013.01);
(Continued)

(58) Field of Classification Search
None
See application file for complete search history.

(56) References Cited

U.S. PATENT DOCUMENTS 5,791,755 A * 8/1998 Henry ..... F21S 10/007 353/120
6,926,427 B2 * 8/2005 Tawil ..... G03B 21/001 362/281
(Continued)

FOREIGN PATENT DOCUMENTS

JP 2007-052957 3/2007
JP 2011-154855 8/2011
(Continued)

*Primary Examiner* — Elmito Breval
(74) *Attorney, Agent, or Firm* — Hammer & Associates, P.C.

(57) ABSTRACT

A light-emitting diode illumination type ellipsoidal spotlight, and more particularly, a light-emitting diode illumination type ellipsoidal spotlight which is capable of drastically prolonging the lifespan of a light source part used in the ellipsoidal spotlight, reducing power consumption and costs related thereto, and producing a variety of colors by manufacturing the light source part of the ellipsoidal spotlight is disclosed.

1 Claim, 6 Drawing Sheets

(51) Int. Cl.

| | |
|---|---|
| ***F21V 29/76*** | (2015.01) |
| ***F21V 3/00*** | (2015.01) |
| ***F21V 5/04*** | (2006.01) |
| ***F21V 17/02*** | (2006.01) |
| ***F21V 17/10*** | (2006.01) |
| ***F21V 17/12*** | (2006.01) |
| ***F21V 21/088*** | (2006.01) |
| ***F21V 21/40*** | (2006.01) |
| ***F21V 23/00*** | (2015.01) |
| ***F21V 23/02*** | (2006.01) |
| ***F21V 23/06*** | (2006.01) |
| ***H05B 33/08*** | (2006.01) |
| ***F21V 5/00*** | (2018.01) |
| ***F21V 21/30*** | (2006.01) |
| *F21W 131/406* | (2006.01) |
| *F21Y 115/10* | (2016.01) |

(52) U.S. Cl.

CPC ..... *F21V 23/005* (2013.01); *F21V 23/02* (2013.01); *F21V 23/06* (2013.01); *F21V 29/673* (2015.01); *F21V 29/677* (2015.01); *F21V 29/76* (2015.01); *H05B 33/0803* (2013.01); *H05B 33/0857* (2013.01); *F21W 2131/406* (2013.01); *F21Y 2115/10* (2016.08)

(56) References Cited

U.S. PATENT DOCUMENTS

2009/0236078 A1* 9/2009 Luo ..... F28D 15/0275 165/80.3
2010/0149822 A1* 6/2010 Cogliano ..... F21S 8/02 362/365
2010/0321950 A1* 12/2010 Wong ..... F21V 29/30 362/547
2011/0216536 A1* 9/2011 Okazaki ..... F21V 29/00 362/235
2011/0305020 A1* 12/2011 Wang ..... F21K 9/00 362/249.02
2012/0211201 A1* 8/2012 Kunstwadl ..... F21V 29/004 165/104.21
2012/0257380 A1* 10/2012 Lefler ..... F21V 5/008 362/157
2013/0003362 A1* 1/2013 Kang ..... F21S 8/043 362/185
2013/0094193 A1* 4/2013 Baxter ..... F21L 4/02 362/184

FOREIGN PATENT DOCUMENTS

KR 20-2005-0014317 5/2005
KR 1020100056550 A 5/2010

* cited by examiner

LIGHT-EMITTING DIODE ILLUMINATION TYPE ELLIPSOIDAL SPOTLIGHT

CROSS-REFERENCE TO RELATED APPLICATION

This application claims priority to and the benefit of Korean Patent Application No. 10-2013-0086313, filed on Jul. 22, 2013, the disclosure of which is incorporated herein by reference in its entirety.

TECHNICAL FIELD

The present invention relates to a light-emitting diode illumination type ellipsoidal spotlight, and more particularly, a light-emitting diode illumination type ellipsoidal spotlight is capable of drastically prolonging a lifespan of a light source part used in an ellipsoidal spotlight, reducing power consumption thereof and costs related thereto, and producing a variety of colors by manufacturing the light source part of the ellipsoidal spotlight. The light-emitting diode illumination type ellipsoidal spotlight, which is one type of stage lighting device, is a condensing illuminator which projects fine rays through an ellipsoidal lens having two surfaces of an elliptical shape, by producing a light-emitting diode (hereinafter, referred to as LED) generating less heat and having low power consumption.

BACKGROUND ART

Generally, in order to make a powerful spotlight for illuminating and placing the spotlight on a person, an object, and the like, or a certain part on a stage, a stage lighting device employs metal halide lamps, mercury lamps, neon lamps, halogen lamps, and the like which provides sufficient illumination, but these lamps have disadvantages in terms of consuming a large amount of energy due to high power consumption, having a short lifespan, and having difficulty in producing a variety of colors of light.

Recently, to address these problems, a stage lighting device employing a light emitting diode (LED), which has low power consumption and a semi-permanent lifespan, takes less time to light, produces a natural light, and reduces generation of harmful substances, is widely being used as a light source part for radiating heat and reducing noise and power consumption.

However, although illumination for a stage should be clear and sharp as is required of a stage lighting device, a conventional stage lighting device has difficulty in terms of adjusting a focus of light which causes a lowered degree of clarity of light depending on a position on a stage, thereby resulting in a degradation of overall light quality.

On the other hand, an ellipsoidal spotlight, which is widely being used as a stage lighting device, is a condensing illuminator projecting fine light through an ellipsoidal lens having two surfaces of an elliptical shape.

Such a spotlight is illuminated through a lamp disposed in front of a main body thereof, and particularly, color illumination may be made by alternately mounting various types of color films on a front side of the lamp to produce various color illuminations.

A conventional spotlight, however, uses a typical lamp which causes problems in terms of having high power consumption resulting in the lack of cost effectiveness, inconvenience in terms of alternately having to mount various types of color films so as to produce color illumination, and a limitation regarding various types of color illumination that can be produced. In addition, the typical lamp generates much heat which increases ambient temperature, and the lifespan of the lamp is drastically shortened due to heat generation which also results in inconvenience caused by the need to frequently replace the lamp and the problem of high cost.

In addition, as described above, the typical lamp generates much heat such that a heat radiation structure needs to be provided in the main body which causes an increase in the complexity of a configuration of the main body.

PATENT DOCUMENTS (Patent Document 1) 1. Korean Laid-Open Patent Application No. 10-2011-0019036 (Feb. 25, 2011)

(Patent Document 2) 2. Korean Laid-Open Patent Application No. 10-2013-0048679 (May 10, 2013)

(Patent Document 3) 3. Korean Laid-Open Patent Application No. 10-2010-0080649 (Jul. 12, 2010)

(Patent Document 4) 4. Korean Patent Registration No. 10-0981920 (Sep. 7, 2010)

DISCLOSURE

Technical Problem

Therefore, in accordance with a purpose of the present invention, along with utilizing a conventional main body, an ellipsoidal spotlight employs a chip-on-board (COB) LED as a light source installed therein, which generates less heat, has low power consumption, and produces illumination of various colors, such that a lifespan of the light source employed in the ellipsoidal spotlight may be considerably prolonged and power consumption and cost related thereto may be considerably reduced to improve economic feasibility. Also, without using separate color film, light of various colors may be conveniently produced through the COB LED such that marketability and reliability of the ellipsoidal spotlight may be drastically increased.

Technical Solution

In accordance with an embodiment of the present invention, an ellipsoidal spotlight includes a main body to which a light radiation part having a transmission window at a front surface thereof and a light source installation part having a handle at a rear surface thereof are coupled to be separable or openable/closable, an angle adjusting and fixing tool coupled to the light source installation part of the main body through a hinge so as to be angle-adjustable and provided with a spotlight fixing clamp on an upper surface thereof, and a light source installed inside the light source installation part of the main body to be attachable and detachable to generate light required for stage lighting, wherein the light source includes a chip-on-board light emitting diode (COB LED) fixed to and installed on a front frame, which is mounted on a front surface of a heat pipe type heat radiation means in a vertical direction, and configured to generate light of predetermined colors required for stage lighting in response to an output voltage of a power supply unit and a control signal output from a control unit, a condensing lens unit fixed and installed through a plurality of supporters separated apart from a front side of the front frame by predetermined distances and configured to condense the light irradiated from the COB LED toward the transmission window of the light radiation part, the heat pipe type heat radiation means tightly installed to a rear surface of the COB LED and configured to radiate heat generated in the COB LED by being integrally provided with a heat pipe filled with a coolant and a heat radiation fin, a main ventilation fan for cooling the heat radiation means installed to the rear surface of the COB LED and configured to forcibly suction external air through an air inlet hole formed between the light radiation part of the main body and the light source installation part to blow the suctioned air toward the heat pipe type heat radiation means, the power supply unit fixed to and installed to an internal side of a rear frame, which is fixed and installed through the plurality of supporters and a plurality of screws separated apart from the front frame by predetermined distances, and configured to provide direct-current (DC) voltage required to drive the COB LED, the control unit fixed to and installed to the internal side of the rear frame and configured to generate color and moving control signals for the COB LED, a main ventilation fan for exhausting air fixed to and installed to an external side of the rear frame and configured to forcibly discharge warm air which is inside the light source installation part, and a rear cover fixed to and installed to the rear frame, configured to discharge the warm air which is inside the light source installation part, having a plurality of air outlets of a bored shape surrounding the main ventilation fan for exhausting air, and on which a power cable connection terminal connected to the outside and a control signal and communication line connection terminal are installed.

At this point, the condensing lens unit may include a cylindrical cap having a predetermined diameter, an aspheric condensing lens installed to an opening of one side of the cylindrical cap and configured to primarily condense the light irradiated from the COB LED into straight parallel light to deliver straight parallel light to a biconvex lens, and the biconvex lens installed to an opening of the other side of the cylindrical cap and configured to focus the light primarily condensed through the aspheric condensing lens on a center point of the transmission window of the light radiation part.

Also, a plurality of auxiliary ventilation fans for cooling the heat radiation means may be further installed to a circumference of the front frame at predetermined intervals to suction external air and intensively supply the suctioned air to the heat radiation fin of the heat pipe type heat radiation means, and may be inclined at a predetermined angle toward the heat pipe type heat radiation means.

Further, a plurality of auxiliary ventilation fans for exhausting air may be further installed to a circumference of the rear frame at predetermined intervals to forcibly discharge the air which is inside the light source installation part, and may be inclined at a predetermined angle toward the air outlets of the rear cover.

In addition, a temperature sensor may be further installed to one side of the heat pipe type heat radiation means to detect temperature thereof in real time and transmit the temperature detected to the control unit, and the control unit may automatically control a rotational speed of the main ventilation fan for cooling the heat radiation means and the main ventilation fan for exhausting air in response to the temperature detected from the temperature detector, and may automatically control a rotational speed and the number of operating fans of the auxiliary ventilation fan for cooling the heat radiation means or the auxiliary ventilation fan for exhausting air based on the temperature of the heat pipe type heat radiation means which is detected by the temperature sensor.

Moreover, a display unit may be further provided at the rear cover to display an operational status of the ellipsoidal spotlight, and a key input unit may be further provided to allow a user to input a predetermined key signal required to control the ellipsoidal spotlight.

Advantageous Effects

As described above, in accordance with the present invention, while maintaining a conventional main body, the ellipsoidal spotlight employs the COB LED as a light source installed therein, which generates less heat, has low power consumption, and can produce illumination of various colors. By installing the heat pipe type heat radiation means having a superior heat radiation efficiency at the rear surface of the COB LED and the plurality of ventilation fans for cooling the heat radiation means in front of and behind thereof, and forcibly suctioning external air inside into the light source installation part and discharging the suctioned air to protect against heat, a lifespan of the light source employed in the ellipsoidal spotlight may be drastically prolonged and power consumption and cost related thereto may be considerably reduced to improve economic feasibility, and also light of various colors may be conveniently produced through the COB LED such that marketability and reliability of the ellipsoidal spotlight may be drastically increased without using separate color film.

MODES OF THE INVENTION

Hereinafter, preferred embodiments according to the present invention will be described in detail with reference to the accompanying drawings.

Figure 1:
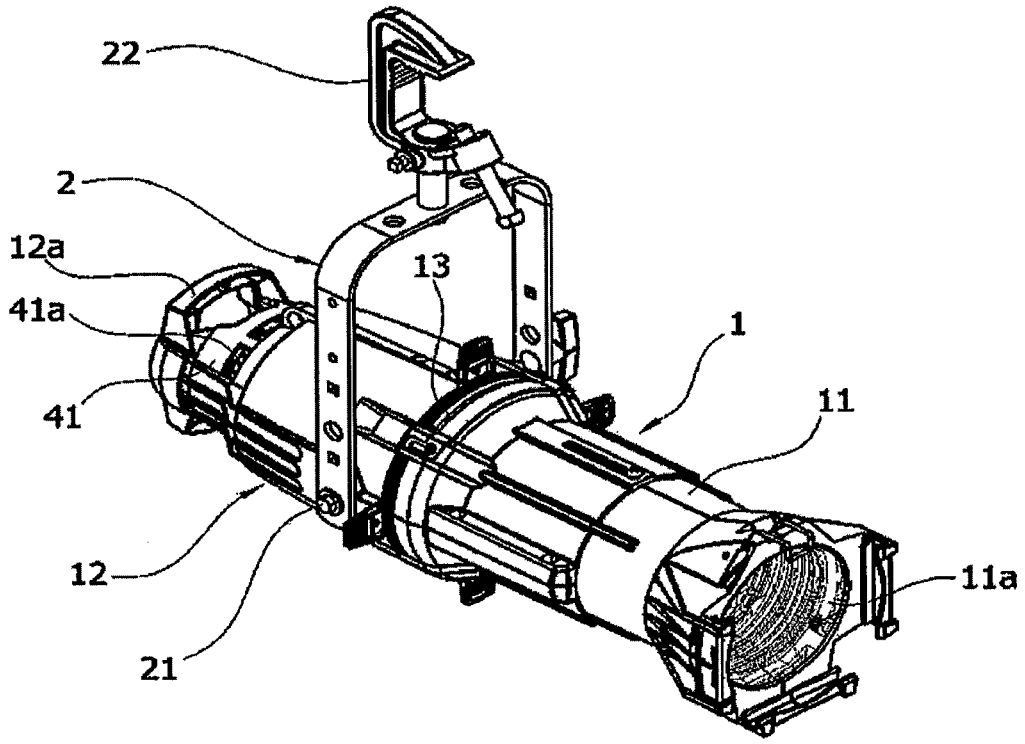
FIG. 1 is a perspective view of an ellipsoidal spotlight according to the present invention.
Figure 2:
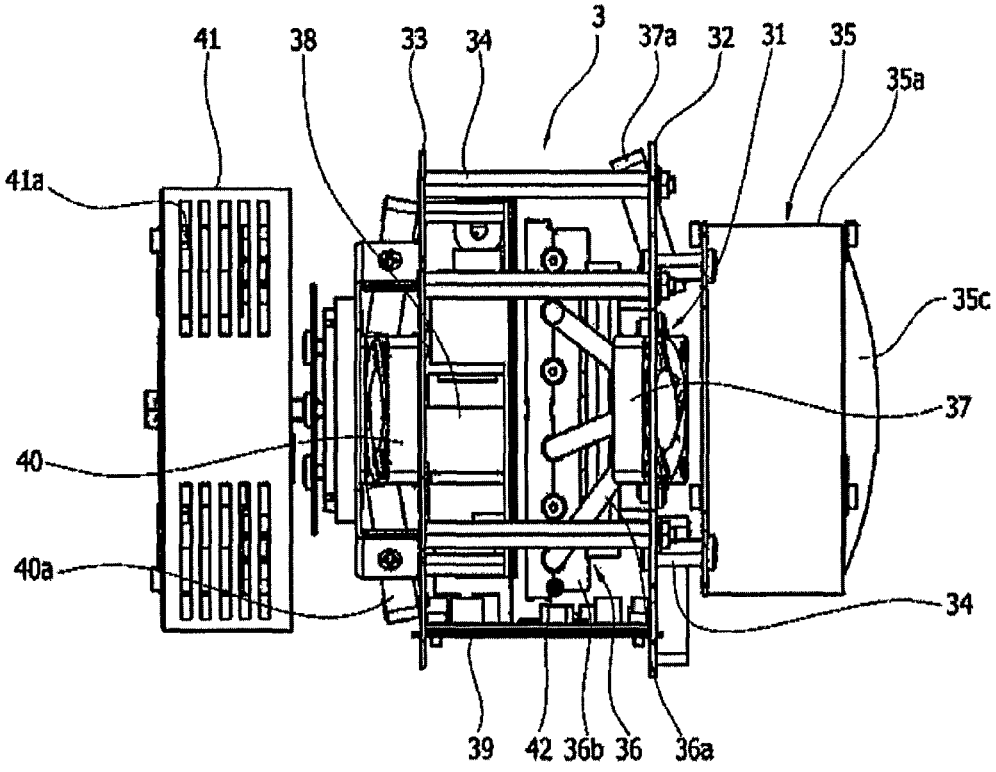
FIG. 2 is a lateral view of a light source employed in the ellipsoidal spotlight according to the present invention.
Figure 3:
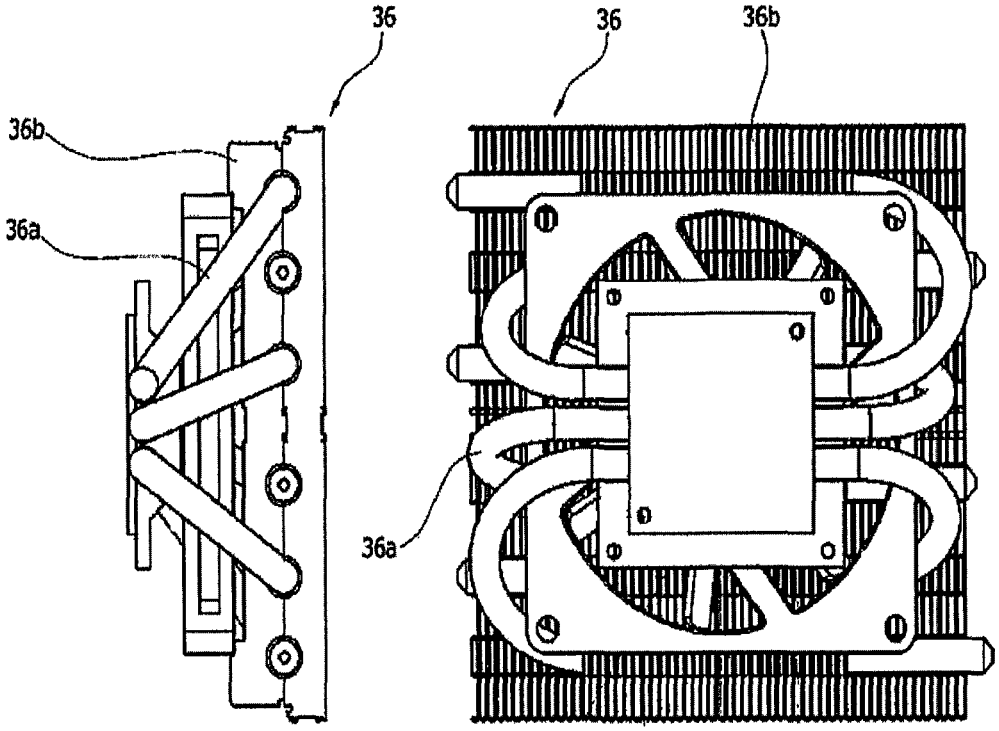
FIG. 3 is the front and lateral views of a heat pipe type heat radiation means of the light source employed in the ellipsoidal spotlight according to the present invention.

FIG. 1 is a perspective view of an ellipsoidal spotlight according to the present invention, FIG. 2 is a lateral view of a light source employed in the ellipsoidal spotlight according to the present invention, and FIG. 3 is the front and lateral views of a heat pipe type heat radiation means of the light source employed in the ellipsoidal spotlight according to the present invention.

Figure 4:
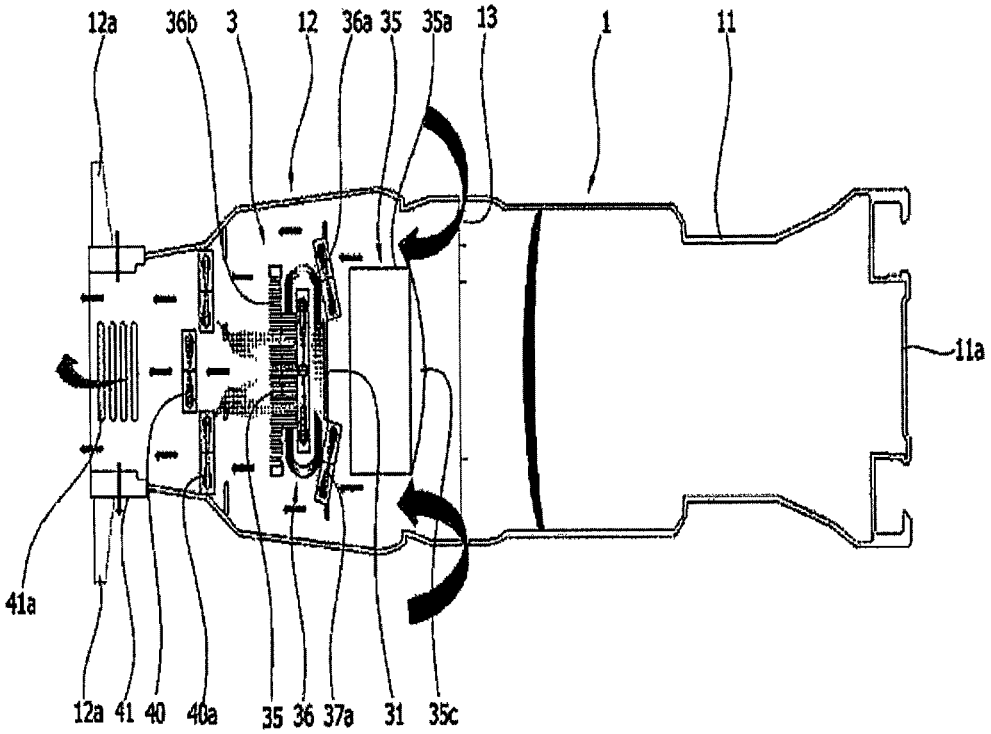
FIG. 4 is a schematic cross-sectional view illustrating a flow of cooling air in the light source of the ellipsoidal spotlight according to the present invention.
Figure 5:
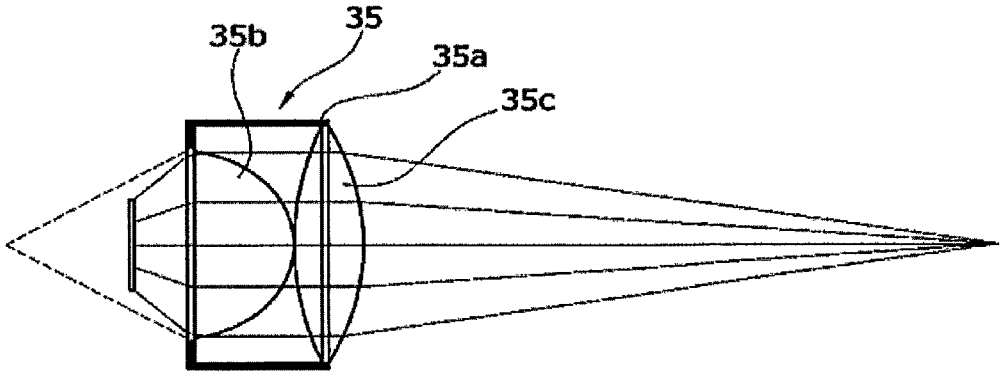
FIG. 5 is a view illustrating a condensed state of light and a cross section of a condensing lens unit of the light source employed in the ellipsoidal spotlight according to the present invention.
Figure 6:
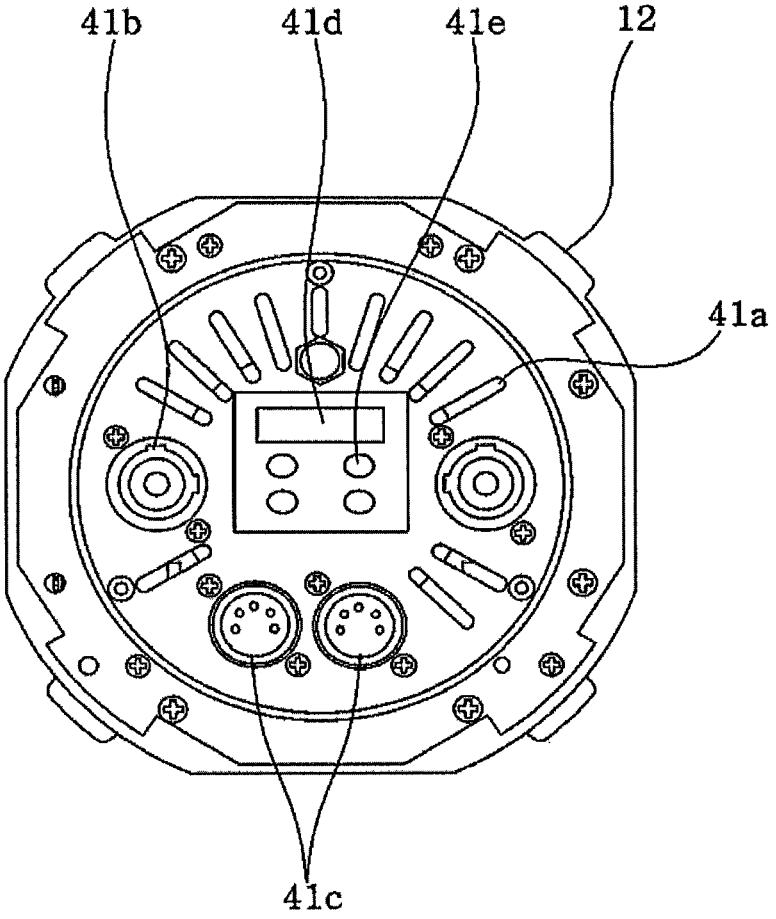
FIG. 6 is a rear view of the light source employed in the ellipsoidal spotlight according to the present invention.

Also, FIG. 4 is a schematic cross-sectional view illustrating a flow of cooling air in the light source of the ellipsoidal spotlight according to the present invention, FIG. 5 is a view illustrating a condensed state of light and a cross section of a condensing lens unit of the light source employed in the ellipsoidal spotlight according to the present invention, and FIG. 6 is a rear view of the light source employed in the ellipsoidal spotlight according to the present invention.

In accordance with the present invention, an ellipsoidal spotlight includes a main body 1 coupled to a light radiation part 11 having a transmission window 11*a* at a front surface thereof and a light source installation part 12 having a handle 12*a* at the rear thereof so as to be separable or openable/closable, an angle adjusting and fixing tool 2 coupled to the light source installation part 12 of the main body 1 through a hinge 21 so as to be angle-adjustable and provided with a spotlight fixing clamp 22 on an upper surface thereof, and a light source part 3 installed inside the light source installation part 12 of the main body 1 to be attachable and detachable and generating light required for stage lighting, wherein the light source part 3 includes a chip-on-board (COB) LED 31 fixed to and installed on a front frame 32 of a plate shape, mounted on a front surface of a heat pipe type heat radiation means 36 in a vertical direction, and generating light of predetermined colors required for stage lighting in response to an output voltage of a power supply unit 38 and a control signal output from a control unit 39, a condensing lens unit 35 fixed and installed through a plurality of supporters 34 separated apart from a front side of the front frame 32 by predetermined distances and condensing light irradiated from the COB LED 31 toward a transmission window of the light radiation part 11, the heat pipe type heat radiation means 36 tightly installed to a rear surface of the COB LED 31 and radiating heat generated in the COB LED 31 by being integrally provided with a heat pipe 36*a* filled with a coolant and a heat radiation fin 36*b*, a main ventilation fan 37 for cooling the heat radiation means installed on the rear surface of the COB LED 31 and forcibly suctioning external air through an air inlet hole 13 formed between the light radiation part 11 of the main body 1 and the light source installation part 12 to blow the suctioned air toward the heat pipe type heat radiation means 36, the power supply unit 38 fixed and installed to an internal side of a rear frame 33 which is integrally fixed and installed to the front frame 32 separated apart from the rear frame by predetermined distances through the plurality of supporters 34 and a plurality of screws, and providing a direct-current (DC) voltage required to drive the COB LED 31, the control unit 39 fixed and installed to the internal side of the rear frame 33 and generating color and moving control signals for the COB LED 31, a rear cover 41 fixed and installed to the rear frame 33, configured to discharge the warm air which is inside the light source installation part 12, having a plurality of air outlets 41*a* of a bored shape surrounding the main ventilation fan for exhausting air 40, and on which a power cable connection terminal 41*b* connected to the outside and a control signal and communication line connection terminal 41*c* are installed.

At this point, the condensing lens unit 35 includes a cylindrical cap 35*a* having a predetermined diameter, an aspheric condensing lens 35*b* installed at an opening of one side of the cylindrical cap 35*a* and condensing the light irradiated from the COB LED 31 into straight parallel light to deliver the straight parallel light to a biconvex lens 35*c*, and the biconvex lens 35*c* installed at an opening of the other side of the cylindrical cap 35*a* and focusing the light primarily condensed through the aspheric condensing lens 35*b* on a center point of the transmission window 11*a* of the light radiation part 11.

Also, a plurality of auxiliary ventilation fans for cooling the heat radiation means 37*a* are further installed to a circumference of the front frame 32 at predetermined intervals to suction external air and intensively supply the suctioned air to the heat radiation fin 36*b* of the heat pipe type heat radiation means 36, and are inclined at a predetermined angle toward the heat pipe type heat radiation means 36.

In addition, a plurality of auxiliary ventilation fans for exhausting air 40*a* are further installed to a circumference of the rear frame 33 at predetermined intervals to forcibly discharge the air which is inside the light source installation part 12, and are inclined at a predetermined angle toward the air outlets 41*a* of the rear cover 41.

At this point, a ventilation capacity of either the auxiliary ventilation fan for cooling the heat radiation means 37*a* or the auxiliary ventilation fan for exhausting air 40*a* is less than that of either the main ventilation fan for cooling the heat radiation means 37 or the main ventilation fan for exhausting air 40.

In addition, a temperature sensor 42 is further installed to one side of the heat pipe type heat radiation means 36 to detect temperature thereof in real time and transmit the temperature detected to the control unit 39, and the control unit 39 automatically controls a rotational speed of the auxiliary ventilation fan for cooling the heat radiation means 37*a* and the auxiliary ventilation fan for exhausting air 40*a* and the number of operating fans thereof in addition to a rotational speed of the main ventilation fan for cooling the heat radiation means 37 and the main ventilation fan for exhausting air 40 based on the temperature detected by the temperature sensor 42.

Moreover, a display unit 41*d* is further provided at the rear cover 41 to display unit an operational status of the ellipsoidal spotlight, and a key input unit 41*e* is further provided so that a user may input a predetermined key signal required to control the ellipsoidal spotlight.

The effectiveness of the light-emitting diode illumination type ellipsoidal spotlight configured as described above will be described below.

Firstly, as shown in FIGS. 1 to 6, a major technical component of the present invention is the said ellipsoidal spotlight comprised of the main body 1, the angle adjusting and fixing tool 2, and the light source part 3, which is provided with the COB LED 31, the condensing lens unit 35, the heat pipe type heat radiation means 36, the main ventilation fan for cooling the heat radiation means 37, the power supply unit 38, the control unit 39, the main ventilation fan for exhausting air 40, and the rear cover 41, and is installed inside the main body 1 so as to be attachable and detachable.

At this point, the main body 1 from among the components of the said ellipsoidal spotlight has a form in which the light radiation part 11 provided with the transmission window 11*a* at the front side thereof and the light source installation part 12 provided with the handle 12*a* are coupled to each other to be separable or openable and closable.

Also, the angle adjusting and fixing tool 2 has a form in which it is coupled to the light source installation part 12 of the main body 1 to be angle-adjustable through the hinge 21 and is provided with the spotlight fixing clamp 22 at an upper surface thereof.

Further, the light source part 3 is basically installed inside the light source installation part 12 of the main body 1 to be attachable and detachable, thereby generating light required for stage lighting, and such a light source part 3 according to the present invention is comprised of the COB LED 31, the condensing lens unit 35, the main ventilation fan for cooling the heat radiation means 37, the power supply unit 38, the control unit 39, the main ventilation fan for exhausting air 40, and the rear cover 41, instead of comprising a typical lamp.

At this point, the COB LED 31 is a COB LED in which an LED chip is directly mounted on a printed circuit board (PCB) substrate and is connected to an electrode through wire bonding, not a surface mount technology (SMT) type LED in which the LED chip is soldered onto the PCB substrate, thereby having a thermal characteristic relatively superior to that of an SMT type LED.

Such a COB LED 31 is fixed and installed to the front frame 32 of a plate shape, which is vertically installed to the front surface of the heat pipe type heat radiation means 36, and serves to generate light of predetermined colors required for stage lighting in response to the output voltage of the power supply unit 38 and the control signal output from the control unit 39.

Also, the condensing lens unit 35 comprised of the cylindrical cap 35*a*, the aspheric condensing lens 35*b*, and the biconvex lens 35*c* is fixed and installed to the front side of the front frame 32 separated apart from the condensing lens unit 35 by a predetermined distance through the supporters 34 and serves to condense the light irradiated from the COB LED 31 into straight parallel light towards the transmission window 11*a* of the light radiation part 11 and to intensively irradiate the light from the COB LED 31 to suitably function as an ellipsoidal spotlight even in regards to long distances.

At this point, the cylindrical cap 35*a* from among the components of the condensing lens unit 35 has a predetermined diameter and serves to integrally fix and install therein the aspheric condensing lens 35*b* and the biconvex lens 35*c* separated apart from each other, and to fix and install the condensing lens unit 35 to the front side of the front frame 32 to be separated apart therefrom by a predetermined distance through the supporters 34.

Also, the aspheric condensing lens 35*b* is installed to the opening of one side of the cylindrical cap 35*a* and primarily condenses the light being inclined and irradiated from the COB LED 31 shown in FIG. 5 into straight parallel light to deliver straight parallel light to the biconvex lens 35*c*.

Further, the biconvex lens 35*c* is installed to the opening of the other side of the cylindrical cap 35*a* as a result of being separated apart from the aspheric condensing lens 35*b* by a predetermined distance to focus the light primarily condensed through the aspheric condensing lens 35*b* on the center point of the transmission window 11*a* of the light radiation part 11.

Meanwhile, the heat pipe type heat radiation means 36 is integrally provided with the heat pipe 36*a* filled with a coolant and the heat radiation fin 36*b*, and performs a function of radiating heat generated from the COB LED 31 as a result of being tightly installed to the rear surface of the COB LED 31.

At this point, the reason that the heat pipe type heat radiation means 36 is employed as a heat radiation means for radiating heat generated from the COB LED 31 instead of a heat radiation fin typically made of aluminum or magnesium is the COB LED 31 employed in the light source part 3 according to the present invention generates much heat and the light source part 3 is installed inside the light source installation part 12 of the main body 1 having a sealed space. Thus, the heat pipe type heat radiation means 36 is employed because it uses coolant to have superior efficiency related to heat protection, and the main ventilation fan for cooling the heat radiation means 37 and the main ventilation fan for exhausting air 40 are installed to efficiently perform heat protection because heat protection is not sufficiently performed by natural convection.

Also, the main ventilation fan for cooling the heat radiation means 37 is installed to the rear surface of the COB LED 31 and suctions external air through the air inlet hole 13 formed between the light radiation part 11 and the light source installation part 12 of the main body 1 to perform a function of forcibly ventilating the suctioned air toward the heat pipe type heat radiation means 36, thereby once again cooling the heat pipe type heat radiation means 36 through air cooling.

Furthermore, the power supply unit 38 is fixed and installed to the internal side of the rear frame 33, which is integrally fixed and installed to the front frame 32 separated apart from the rear frame 33 by a predetermined distance through the plurality of supporters 34 and the plurality of screws and is parallel in the vertical direction, to perform a function of supplying DC voltage required to drive the COB LED 31.

In addition, the control unit 39 is provided with a predetermined control program and is fixed and installed to the internal side of the rear frame 33 so as to have a form in which the control unit 39 is connected to an external main control unit, and performs a function of generating a variety of control signals (for example, ON/OFF signals, color signals, a light brightness signal, a moving signal, and the like) for the COB LED 31.

Also, the main ventilation fan for exhausting air 40 is fixed and installed to the external side of the rear frame 33 and forcibly discharges heat generated from not only the heat pipe type heat radiation means 36 but also the power supply unit 38, the control unit 39, and the like, to the outside through a method of forcibly discharging warm air which is inside the light source installation part 12 to the outside, thereby preventing damage to these components due to heat.

Moreover, the rear cover 41 has a configuration in which a plurality of air outlets 41*a* of a bored shape are comprised and to which the power cable connection terminal 41*b* connected to the outside and the control signal and communication line connection terminal 41*c* are installed, and the rear cover 41 is fixed and installed to the rear frame 33 in a form which surrounds the main ventilation fan for exhausting air 40, thereby performing functions of discharging the air which is inside the light source installation part 12 and protecting the various electrical and electronic components therein.

Meanwhile, heat generated from the COB LED 31 varies according to light output therefrom, so that sufficient heat protection and cooling effectiveness may not be obtained through only the main ventilation fan for cooling the heat radiation means 37 and the main ventilation fan for exhausting air 40 when the COB LED 31 generates high light output.

Therefore, according to the present invention, the plurality of auxiliary ventilation fans for cooling the heat radiation means 37*a* may be further installed to the circumference of the front frame 32 at predetermined intervals to suction external air and intensively supply the suctioned air to the heat radiation fin 36*b* of the heat pipe type heat radiation means 36 if necessary, and may be installed to be inclined toward the heat pipe type heat radiation means 36, thereby effectively cooling the heat pipe type heat radiation means 36 in association with the main ventilation fans for the heat radiation means 37 having a ventilation capacity relatively greater than that of the plurality of auxiliary ventilation fans for cooling the heat radiation means 37*a*.

Additionally, according to the present invention, the auxiliary ventilation fans for exhausting air 40*a* may be installed to the circumference of the rear frame 33 at predetermined intervals to forcibly discharge the air which is inside the light source installation part 12 if necessary, and may be installed to be inclined toward the air outlets 41*a* of the rear cover 41, thereby intensively discharging the air which is inside the light source installation part 12 to the air outlets 41*a* in association with the main ventilation fans for exhausting air 40 having a ventilation capacity relatively greater than that of the auxiliary ventilation fans for exhausting air 40*a* which discharges heat generated from the various components which is inside the light source installation part 12.

Moreover, according to the present invention, the temperature sensor 42 may be further installed to one side of the heat pipe type heat radiation means 36 if necessary, and may detect a temperature of the heat pipe type heat radiation means 36 in real time to transmit the detected temperature to the control unit 39 while the ellipsoidal spotlight according to the present invention operates, and also the control unit 39 may automatically control not only the rotational speed of the main ventilation fan for cooling the heat radiation means 37 and the main ventilation fan for exhausting air 40 but also the rotational speed of and the number of fans being operated among the auxiliary ventilation fans for cooling the heat radiation means 37*a* and the auxiliary ventilation fans for exhausting air 40*a* based on the temperature detected by the temperature sensor 42.

Therefore, in response to a heat generation rate of the heat pipe type heat radiation means 36, the rotational speed of the main ventilation fan for cooling the heat radiation means 37 and the main ventilation fan for exhausting air 40 may be proactively controlled, and also the rotational speed of and the number of fans being operated among the auxiliary ventilation fans for cooling the heat radiation means 37*a* and the auxiliary ventilation fans for exhausting air 40*a* may be proactively and automatically controlled, such that unnecessary power consumption may be prevented and noise generation due to a maximum operation of all ventilation fans may also be prevented in advance.

Also, according to the present invention, in addition to the installation of the power cable connection terminal 41*b* and the control signal and communication line connection terminal 41*c* to the rear cover 41, the display unit 41*d* for displaying an operational status of the ellipsoidal spotlight and the key input unit 41*e* for receiving predetermined key signals required to control the ellipsoidal spotlight by the user may be further provided if they are necessary such that the ellipsoidal spotlight according to the present invention may be effectively operated.

Although the embodiments have been described with reference to a number of illustrative embodiments thereof, it should be understood that numerous other modifications and embodiments can be devised by those skilled in the art that fall within the spirit and scope of the principles of this disclosure. The embodiments disclosed herein, therefore, are not to be taken in a sense of limiting the technical concept of the present invention but as an explanation thereof, and the range of the technical concept is not limited to these embodiments. The scope of the present invention should be construed by the appended claims, along with the full range of equivalents to which such claims are entitled.

[Description of Reference Numerals]

| | |
|---|---|
| 1: main body | |
| 11: light radiation part | 11a: transmission window |
| 12: light source installation part | 12a: handle |
| 13: air inlet hole | |
| 2: angle adjusting and fixing tool | |
| 21: hinge | 22: spotlight fixing clamp |
| 3: light source part | |
| 31: COB LED | 32: front frame |
| 33: rear frame | 34: supporters |
| 35: condensing lens unit | 35a: cylindrical cap |
| 35b: aspheric condensing lens | 35c: biconvex lens |
| 36: heat pipe type heat radiation means | |
| 36a: heat pipe | 36b: heat radiation fin |
| 37: main ventilation fan for cooling the heat radiation means | |
| 37a: auxiliary ventilation fan for cooling the heat radiation means | |
| 38: power supply unit | 39: control unit |
| 40: main ventilation fan for exhausting air | |
| 40a: auxiliary ventilation fan for exhausting air | |
| 41: rear cover | 41a: air outlet hole |
| 41b: power cable connection terminal | |
| 41c: control signal and communication line connection terminal | |
| 41d: display unit | 41e: key input unit |
| 42: temperature sensor | |

The invention claimed is:

1. A light-emitting diode illumination type ellipsoidal spotlight comprising:

a main body to which a light radiation part having a transmission window at a front surface thereof and a light source installation part having a handle at a rear surface thereof are coupled to be separable or openable/closable;

an angle adjusting and fixing tool coupled to the light source installation part of the main body to be angle-adjustable through a hinge and provided with a spotlight fixing clamp on an upper surface thereof; and a light source part installed inside the light source installation part of the main body to be attachable and detachable to generate light required for stage lighting, wherein the light source part includes:

a chip-on-board light emitting diode (COB LED) fixed to and installed to a front frame, which is mounted on a front surface of a heat pipe type heat radiation means in a vertical direction, and configured to generate light of predetermined colors required for the stage lighting in response to an output voltage of a power supply unit and a control signal output from a control unit;

a condensing lens unit fixed and installed through a plurality of supporters to be separated apart from a front side of the front frame by a predetermined distance and configured to condense the light irradiated from the COB LED toward the transmission window of the light radiation part;

the heat pipe type heat radiation means tightly installed at a rear surface of the COB LED and configured to radiate heat generated from the COB LED by being integrally provided with a heat pipe filled with a coolant and a heat radiation fin;

a main ventilation fan for cooling the heat radiation means installed to the rear surface of the COB LED and configured to forcibly suction external air through an air inlet hole formed between the light radiation part of the main body and the light source installation part to blow the suctioned air toward the heat pipe type heat radiation means;

the power supply unit fixed to and installed to an internal side of a rear frame, which is integrally fixed and installed through the plurality of supporters and a plurality of screws to be separated apart from the front frame by a predetermined distance, and configured to provide a direct-current (DC) voltage required to drive the COB LED;

the control unit fixed to and installed at the internal side of the rear frame and configured to generate color and moving control signals for the COB LED;

a main ventilation fan for exhausting air fixed to and installed at an external side of the rear frame and configured to forcibly discharge warm air which is inside the light source installation part; and a rear cover fixed to and installed at the rear frame, configured to discharge the warm air which is inside the light source installation part, having a plurality of air outlets of a bored shape surrounding the main ventilation fan for exhausting air, and on which a power line connection terminal connected to the outside and a control signal and communication line connection terminal are installed, wherein the condensing lens unit includes:

a cylindrical cap having a predetermined diameter;

an aspheric condensing lens installed at an opening of one side of the cylindrical cap and configured to primarily condense the light irradiated from the COB LED into straight parallel light to deliver the straight parallel light to a biconvex lens; and the biconvex lens installed at an opening of the other side of the cylindrical cap and configured to focus the light primarily condensed through the aspheric condensing lens on a center point of the transmission window of the light radiation part, wherein a plurality of auxiliary ventilation fans for cooling the heat radiation means are installed at a circumference of the front frame at predetermined intervals to suction external air and intensively supply the suctioned air to the heat radiation fin of the heat pipe type heat radiation means, and are inclined at a predetermined angle toward the heat pipe type heat radiation means, a plurality of auxiliary ventilation fans for exhausting air installed at a circumference of the rear frame at a predetermined interval to forcibly discharge the air which is inside the light source installation part, and are inclined at a predetermined angle toward the air outlets of the rear cover, a temperature sensor installed at one side of the heat pipe type heat radiation means to detect temperature thereof in real time and transmit the detected temperature to the control unit, wherein the control unit automatically controls rotational speed of the main ventilation fan for cooling the heat radiation means and the main ventilation fan for exhausting air in response to the temperature detected by the temperature sensor, and automatically controls a rotational speed and the number of operating fans of the auxiliary ventilation fan for cooling the heat radiation means or the auxiliary ventilation fan for exhausting air in response to the temperature of the heat pipe type heat radiation means which is detected by the temperature sensor, a display unit that is provided at the rear cover to display an operational status of the ellipsoidal spotlight, and a key input unit that is provided to allow a user to input predetermined key signals required to control the ellipsoidal spotlight.

* * * * *